United States Patent [19]

Nishioka

[11] Patent Number: 5,024,017

[45] Date of Patent: Jun. 18, 1991

[54] TRIGGER COVER

[76] Inventor: Jim Z. Nishioka, 1268 Hemlock NW, Salem, Oreg. 97304

[21] Appl. No.: 555,837

[22] Filed: Jul. 20, 1990

[51] Int. Cl.[5] ..... F41A 17/54

[52] U.S. Cl. ..... 42/70.07

[58] Field of Search ..... 42/70.07

[56] References Cited

U.S. PATENT DOCUMENTS

| | | | |
|---|---|---|---|
| 955,237 | 4/1910 | Westcott et al. | 42/70.07 |
| 2,080,202 | 5/1937 | Drake | 42/1 |
| 2,525,886 | 10/1950 | Fraser | 42/70.07 |
| 2,590,516 | 3/1952 | De Von Breymann | 42/70 |
| 2,709,865 | 6/1955 | Bohenek | 42/70.07 |
| 3,269,046 | 8/1966 | Schaefer | 42/70 |
| 3,964,200 | 6/1976 | Patterson | 42/70.07 |
| 4,422,254 | 12/1983 | McQueen | 42/70.07 |

FOREIGN PATENT DOCUMENTS

| | | | |
|---|---|---|---|
| 117 | 8/1899 | Austria | 42/70.07 |
| 446668 | 7/1927 | Fed. Rep. of Germany | 42/70.07 |
| 350867 | 6/1905 | France | 42/70.07 |
| 4626 | of 1905 | United Kingdom | 42/70.07 |
| 6761 | of 1910 | United Kingdom | 42/70.07 |

*Primary Examiner*—Richard W. Wendtland

[57] ABSTRACT

A combination includes a gun and a trigger cover. The gun includes a trigger, a trigger guard and an elongated barrel extending longitudinally in a shooting direction of the gun. The trigger cover is for covering the trigger and includes an open position and a closed position. The open position being for exposing the trigger and allowing access to and operation of the latter. The closed position being for covering and restricting access to the trigger. The trigger cover is connected to the gun in both the open and closed positions. The trigger cover is slidably connected to the gun.

15 Claims, 2 Drawing Sheets

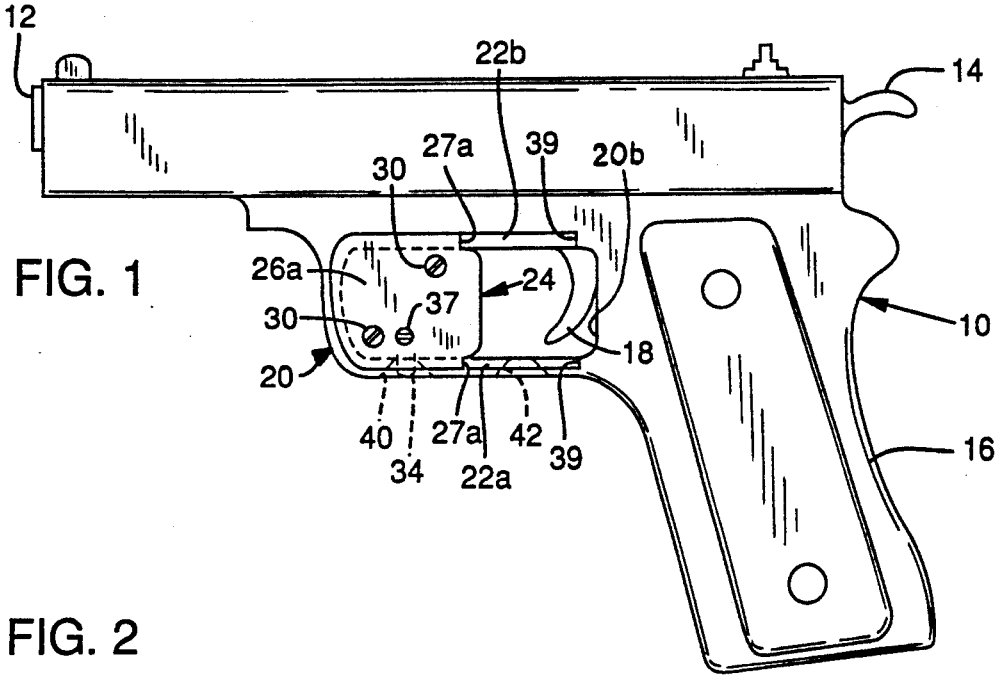
FIG. 1
FIG. 2
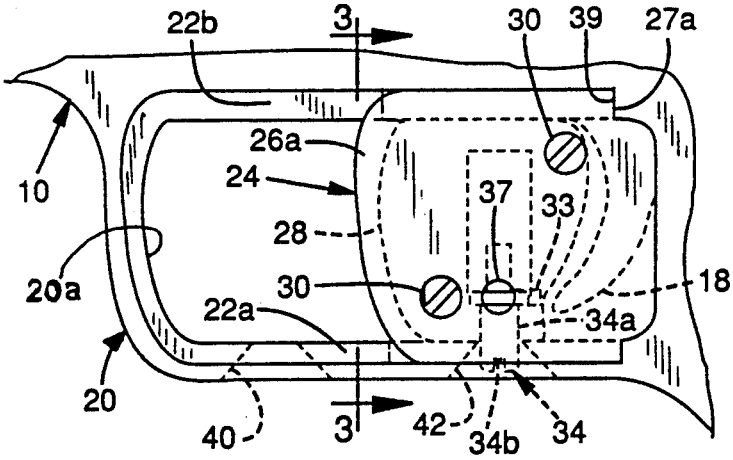
FIG. 3
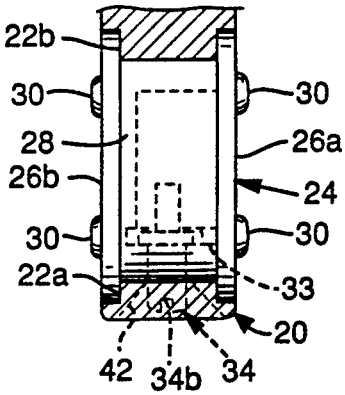
FIG. 4
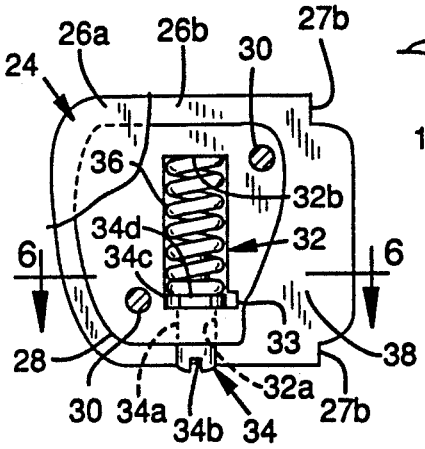
FIG. 5
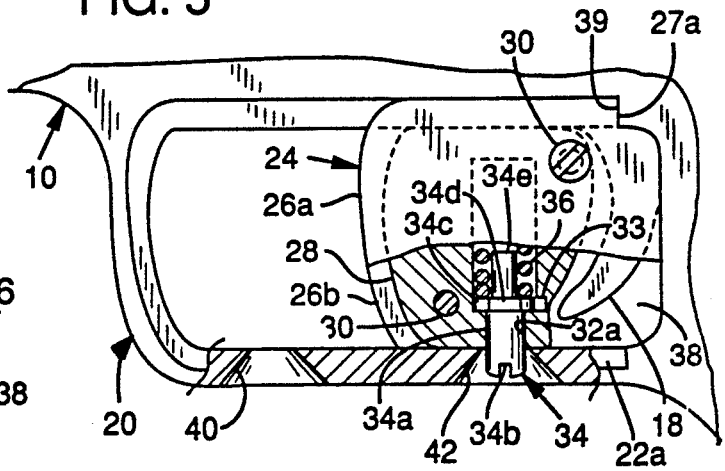

TRIGGER COVER

CROSS-REFERENCE TO RELATED APPLICATION

This application is related to the applicant's co-pending application: Ser. No. 425,283, filed 10/23/89.

BACKGROUND OF THE INVENTION

This invention relates to new and useful improvements in trigger covers for shooting devices such as guns.

SUMMARY OF THE INVENTION

According to the present invention and forming primary objectives thereof, a trigger cover for shooting devices is provided having novel structural arrangements.

Some prior trigger covers are shown in U.S. patents which remain on the gun when not in use. Examples of such covers are shown in patents Schaefer U.S. Pat. No. 3,269,046 and De Von Breymann U.S. Pat. No. 2,590,516. The shield or cover 11 of the device shown in 3,269,046 extends downwardly from the trigger guard 14 when in the open or non-use position. This is best seen in FIG. 3. Referring to the device shown in U.S. Pat. No. 2,590,516, the element or cover 140, best seen in FIG. 14, is pivoted upwardly away from the guard 12 when the cover is in the open or non-operative position indicated by the broken line. Only the cross piece 166 remains in the guard when the cover is in the open position. The cover requires a recess in the stock 14 to function as intended.

Examples of prior U.S. patents showing tool-activated trigger locks are shown in Foote U.S. Pat. No. 3,422,560, Shinaver U.S. Pat. No. 2,882,636 and Rogers U.S. Pat. No. 3,066,433.

None of the trigger covers shown in the prior patents are positioned in the trigger guard in the non-use position. Furthermore, none of such patents show a trigger cover which is slidably connected to the gun.

An objective of the present invention is to provide a trigger cover which remains on the gun in the open position and causes minimal disruption of the gun's profile to provide ease of handling and esthetic appeal.

Another objective of the present invention is to provide a trigger cover which remains on the gun in the open position and eliminates the need for a recess in the stock.

Still another objective of the present invention is to provide a trigger cover which is slidably supported on the gun.

Still another objective of the present invention is to provide a trigger cover wherein, when in the open position, a substantial portion of the cover remains in the trigger guard to provide a compact profile for the gun.

The invention will be better understood and additional objectives and advantages will become apparent from the following description taken in connection with the accompanying drawings.

BRIEF DESCRIPTION OF THE DRAWINGS

FIG. 1 is a side elevational view of a gun and a trigger cover embodying principles of the present invention;

FIG. 2 is an enlarged fragmentary side elevational view of the trigger cover and the trigger guard;

FIG. 3 is a sectional view taken on line 3—3 of FIG. 2;

FIG. 4 is a side elevational view of the trigger cover shown in FIGS. 1 and 2 with one of the side walls partially broken away;

FIG. 5 is similar to the view of FIG. 2 except a portion of the cover and a portion of the trigger guard have been broken away;

DETAILED DESCRIPTION OF PREFERRED EMBODIMENTS

Figure 6:
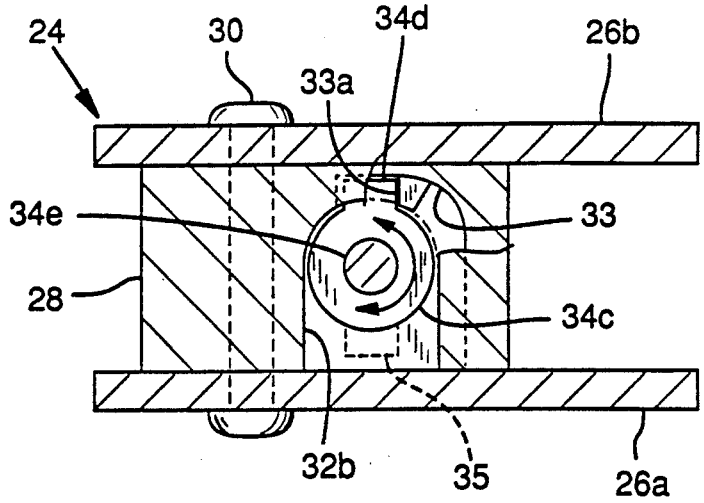
FIG. 6 is an enlarged overhead sectional view taken on line 6—6 of FIG. 4 with a portion of the middle portion broken away and the spring omitted.
Figure 7:
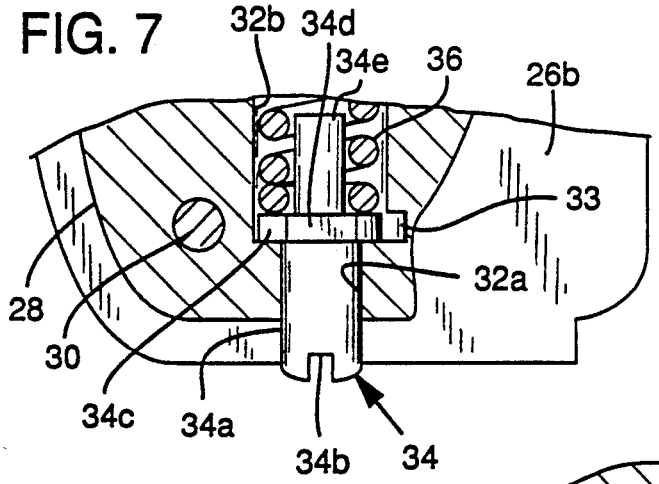
FIG. 7 is an enlarged fragmentary side elevational sectional view of the trigger cover.

With reference to the drawings, a preferred embodiment of the present invention embodying principles of the present invention is shown.

A gun 10 includes an elongated barrel 12 which extends longitudinally in a shooting direction of the gun, a hammer 14, a grip 16, a trigger 18 and a trigger guard 20.

A pair of elongated elements 22*a* and 22*b* extends forwardly and longitudinally in the shooting direction of the gun. The elements slidably connect a trigger cover 24 to the gun 10. Such elements also guide the cover during its sliding movements. The bottom elongated element 22*a* extends longitudinally along the bottom portion of the trigger guard 20 and the top elongated element 22*b* is positioned above and extends parallel to the bottom elongated element 22*a*.

The trigger cover 24 includes a pair of side walls 26*a* and 26*b* and a pair of notches 27*a* and 27*b*, respectively. The side walls are positioned on opposite sides of a middle portion 28. The side walls are secured to the middle portion by bolts 30, best seen in FIG. 3. Such bolts may be of the removable type to allow the side walls 26*a* and 26*b* and the middle portion 28 to be assembled on the trigger guard 20.

The trigger guard 20 includes a forward wall 20*a* and a rearward wall 20*b*.

The middle portion 28 includes an aperture 32, a locking recess 33 and a raised anti-rotation portion 33*a*. The aperture 32 includes a bore portion 32*a* which receives a stud 34. An unlocked position of the stud is indicated by a broken line 35 in FIG. 6. The aperture 32 also includes an enlarged portion 32*b* which receives a spring 36. The aperture 32 allows the stud to be pushed upwardly by the operator against the resistance of the spring. The spring urges the stud in a downwardly direction. The stud extends vertically relative to the trigger cover.

Figure 8:
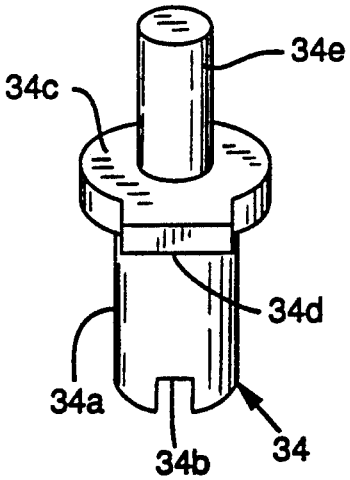
FIG. 8 is an enlarged perspective view of the stud.

The stud 34, best seen in FIG. 8, includes a shaft 34*a* and an aperture 34*b* positioned on the bottom end of such shaft for operatively receiving a tool to rotate the stud. The stud also includes an extension 34*c* and an upwardly extending portion 34*e*. The latter aligning the spring relative to the stud.

The extension 34*c* of the stud supports a recess engaging portion 34*d* for engaging the locking recess 33. The recess engaging portion 34*d* is operatively connected to the stud shaft 34*a* by the extension 34*c*. Furthermore, the recess engaging portion 34*d* may extend directly to the stud shaft 34*a* thereby eliminating the extension 34*c*.

A window 37, shown in FIGS. 1 and 2, is positioned in the side wall 26*a* of the trigger cover 24 so that the operator can observe the status of the stud 34. Portions of such stud may be colored or otherwise marked to indicate a locked or an unlocked status of the stud.

The trigger cover 24 also includes a trigger receiving recess 38 positioned in the rearward portion of such cover, best seen in FIG. 4. Such recess is formed by the side walls 26*a* and 26*b* which extend rearwardly past the middle portion 28. The recess receives the trigger 18 when the cover 24 is slid from the open position shown in FIG. 1 to the closed position shown in FIG. 2.

The side walls 26*a* and 26*b* of the trigger cover 24, best seen in FIG. 3, extend vertically beyond the middle portion 28 and form bottom and top elongated slots which slidably engage the elongated elements 22*a* and 22*b*, respectively. The elongated slots extend longitudinally from the front portion of the trigger cover to the rear portion of the trigger cover. Such slots keep the cover in proper alignment during horizontal sliding movements in the trigger guard 20. The cover slides forwardly from the closed position to the open position on a horizontal plane substantially parallel to the barrel 12 and also substantially parallel to the shooting direction of the gun 10.

The notches 27*a* and 27*b*, which are positioned on the rearward portions of the side walls 26*a* and 26*b* of the cover 24, respectively, engage the ridge portions 39 on the rearward portion of the trigger guard 20 when the operator slides the cover rearwardly from the open position shown in FIG. 1 to the closed position shown in FIG. 2. The engagement of the notches 27*a* and 27*b* with the ridge portions 39 stops the rearward movement of the cover 24 and prevents contact of the middle portion 28 of the cover with the trigger 18.

The closed position of the trigger cover 24 shown in FIG. 2 covers the trigger 18 and restricts access to such trigger to help prevent accidental firing of the gun. Covering the trigger also discourages unauthorized use of such gun.

The trigger cover 24 is shown in the open position in FIG. 1 which allows access to the trigger 18 and operation of the gun. In such open position, the trigger cover 24 is positioned in front of the trigger 18. This also is seen in FIG. 1.

A pair of apertures 40 and 42 extends through the lower elongated element 22*a* and the trigger guard 20. Such apertures allows the cover 24 to be held in the open or the closed positions by the stud 34. The apertures 40 and 42 are shown in FIGS. 5 and are also indicated by broken lines in FIG. 2. The apertures receive the stud 34.

In the open position of the cover 24 shown in FIG. 1, the aperture 40 in the trigger guard 20 receives the stud 34 to hold the cover in such open position.

When the cover 24 is in the closed position shown in FIGS. 2 and 5, the aperture 42 in the trigger guard 20, receives the stud 34 to hold the cover in the closed position. The stud extends into or through the lower elongated element and the trigger guard 20 in the hold position. The stud is vertically positioned in the cover.

To move the cover 24 from the open position shown in FIG. 1 to the closed position shown in FIG. 2, the operator applies pressure to the stud 34 against the resistance of the resilient spring 36. This releases the hold of the aperture 40 on the stud 34 and allows the cover to slide rearwardly to the closed position. When the cover reaches the closed position, the spring 36 will urge the stud 34 to enter the aperture 42 and hold such cover in the closed position. The engagement of the stud in the aperture will resist horizontal sliding movements of the cover. This is best seen in FIG. 5.

To move the cover 24 from the closed position shown in FIG. 2 to the open position shown in FIG. 1, the operator applies pressure to the stud 34 against the spring 36 to disengage and release such stud from the aperture 42. The operator then slides the cover forwardly to the open position shown in FIG. 1. When the cover reaches the open position, the spring 36 will urge the stud 34 in a downwardly direction and such stud will engage the aperture 40 in the trigger guard 20. The engagement of the stud in the aperture 40 will hold the cover in the open position and resist horizontal sliding movements of such cover.

This invention also is provided with a locking feature which locks the cover 24 in the hold position. Such locking feature includes the locking recess 33 which is connected to the aperture 32, best seen in FIG. 9. Such locking recess receives the recess engaging portion 34*d* when the stud 34 is rotated by a tool. As can be seen in FIG. 6, which shows the stud rotated to the locked position, the recess engaging portion 34*d* of the stud is positioned in the locking recess 33. This restricts or stops upwardly movements of the stud so that such stud cannot be depressed sufficiently to clear the elongated element 22*a*. A portion of the middle portion 28, also shown in FIG. 6, is broken away to expose the recess engaging portion 34*d* and to illustrate its engagement with the locking recess 33.

The engagement of the stud 34 with the aperture 42, best seen in FIG. 5, holds the cover 24 in the closed position. The engagement of the recess engaging portion 34*d* with the locking recess 33, best seen in FIG. 6, locks the stud 34 in the hold position.

The trigger cover 24 may be used with only the hold feature, which requires pressure on the stud 34 to release the cover. The cover may also be used with both the hold feature and the locking feature. To move the cover when it is in the locked position, the operator must first rotate the stud and then depress the stud.

To unlock the cover shown in FIG. 6, the operator rotates the stud 34, which rotates the recess engaging portion 34*d* out of the locking recess 33, to a position indicated by the broken line 35. In this unlocked position the stud will still hold the cover in position. The stud is unlocked but in the hold position.

Furthermore, this invention also is provided with an anti-rotation feature for stopping or restricting rotating movements of the stud 34 after the latter has been rotated to the locked position.

The raised anti-rotation portion 33*a* is positioned on the bottom portion of the locking recess 33. Such anti-rotation portion stops unlocking rotating movements of the stud 34 after the latter has been rotated to the locked position. The spring 36 urges the recess engaging portion 34*d* downwardly to the position shown in FIG. 10. An operator pushing pressure on the stud against the spring will cause the recess engaging portion 34*d* to clear the raised anti-rotation portion 33*a* and allow unlocking rotation of the stud to the position indicated by the broken line 35 seen in FIG. 6.

To unlock the cover, when the anti-rotation feature is employed, the operator must apply a simultaneous pushing pressure and a rotating movement to the stud 34. This is a desirable child-resisting and tamper-proofing feature which promotes gun safety.

It can now be seen that a substantial portion of the cover 24 is positioned in the trigger guard 20 in both the open position shown in FIG. 1 and in the closed position shown in FIG. 2. This is an important feature which provides a convenient trigger cover and also provides a compact profile for the gun.

Furthermore, the fact that a substantial portion of cover 24 is positioned in the trigger guard 20, allows use of holsters in the usual manner. The cover, in the open position, does not extend downwardly as shown in some prior structures. Such downwardly positioning of the cover in the open position increases the profile of the gun and would require the use of special holsters.

Portions of the cover 24, such as the side walls 26*a* and 26*b* and the stud 34, may extend outwardly from the trigger guard 20, however, a substantial portion of the cover will be within the confines of such trigger guard in both the closed and the open positions.

The fact that the cover 24 slides between the open position shown in FIG. 1 and the closed position shown in FIG. 2 is believed to be a novel and important feature. Such sliding movements help provide a compact profile for the gun while being esthetically appealing. Furthermore, such sliding cover is simple and economical to manufacture.

Another important feature of the present invention is the fact that the trigger cover 24, in the position shown in FIG. 1, is positioned in front of the trigger 18. This also helps provide a compact profile for the gun. Such cover remains in a horizontal alignment with the trigger during its sliding movements in the trigger guard 20.

A substantial portion of the trigger cover 24 remains in the trigger guard 20 during the cover's movement from the closed position to the open position. Furthermore, a substantial portion of the trigger cover 24 remains in the trigger guard 20 during the cover's movement from the open position to the closed position.

Furthermore, the side walls 26*a* and 26*b* include portions which cover the trigger 18 when the trigger cover 24 is in the closed position shown in FIG. 2. Such portions remain between the forward wall 20*a* and the rearward wall 20*b* of the trigger guard 20 in the open position shown in FIG. 1 and also in the closed position shown in FIG. 2.

Many trigger guards presently on the market may be modified to employ the applicant's trigger cover. The trigger guard 20 and the trigger cover 24 may be manufactured separately and sold as after-market products.

While the above description contains many specifics, the reader should not construe these as limitations on the scope of the invention, but merely as examples of the preferred embodiments thereof. Alternate constructions and modifications include the following:

An alternate construction of the locking means for the trigger cover 24 is to replace the aperture 32 with a threaded bore and replace the stud 34 with a threaded bolt. The lower portion of the threaded bore would include an enlarged portion to receive the bolt head and allow vertical movement of such bolt head. The bolt would include a tool receiving means such as the aperture 34*b* shown on the stud 34. The bolt head would be engaged through either aperture 40 or 42. The bolt, when tightened, would engage the upper elongated element 22*b* and force the middle portion 28 downwardly against the lower elongated element 22*a* to lock the cover in position. Furthermore, the upper elongated element 22*b* could include an aperture to receive the threaded end of the bolt when it is tightened to the lock position.

Another alternate construction of the locking means for the trigger cover 24 would be to position the activating means on the side of such cover rather than on the bottom as shown in the preferred embodiment. To accomplish this the side wall 26*a* would be constructed with an elongated vertical slot. A cross piece could be connected to the stud 34 and extend transversely through the elongated vertical slot so that the operator could grasp such cross piece. To operate such a modification, the operator would engage the cross piece and force the stud upwardly against the spring 36 so that the stud 34 is disengaged from the elongated element 22*a* and the bottom portion of the trigger guard 20. The elongated vertical slot would allow such vertical movement of the cross piece and the stud. Similar to the preferred embodiment shown, the trigger cover then could be moved to the desired position and the spring 36 would cause the stud to engage the elongated element 22*a* and the trigger guard 20. The elongated vertical slot can replace the window 37 shown in FIG. 2. Furthermore, the middle portion may be provided with an elongated vertical slot and both the side walls 26*a* and 26*b* may be provided with corresponding elongated vertical slots. The cross piece would extend through both side walls and the middle portion.

Still another alternate construction of the cover locking means would be to employ a bolt mounted through the front of the trigger guard 20. Such bolt would be free to rotate and include a collar or flange near the bolt head to retain the bolt in the guard. The opposite end portion of the bolt would be threaded. A horizontally positioned threaded bore would extend through the middle portion 28 of the trigger cover 24 and receive the threaded portion of the bolt. Rotating the bolt would cause the cover to slide forwardly or rearwardly to an open or a closed position.

Figure 9:
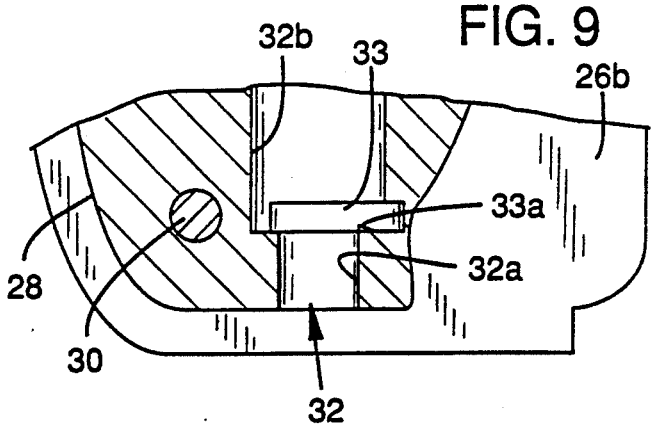
FIG. 9 is the view shown in FIG. 7 with the stud and spring omitted.
Figure 10:
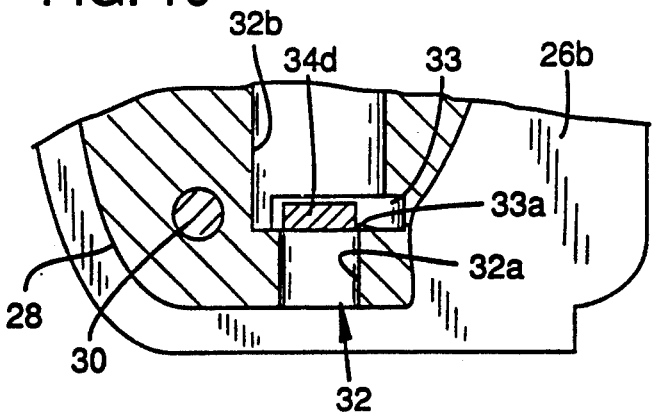
FIG. 10 is the view shown in FIG. 9 with a sectional view of the recess engaging portion 34*d* in the locking recess 33.

Still another alternate construction would be to modify the anti-rotation device shown in FIGS. 6, 9 and 10. The recess 33 may be provided with a depression or recess positioned to the left of the raised portion 33*a* to accomplish the same function as the latter. The depression would be shaped to receive the recess engaging portion 34*d*. The spring 36 would urge the recess engaging portion 34*d* into the depression. Such depression would replace the raised portion 33*a* and receive the recess engaging portion 34*d* and allow it to drop below the bottom of the recess 33 thereby holding the stud 34 in the locked position. The stud could be modified, as described earlier, so that the recess engaging portion 34*d*, best seen in FIG. 8, extends directly to the stud shaft 34*a* and the flange-like extension 34*c* omitted. Such modified recess engaging portion 34*d* would support the spring 36 and position the stud 34 in the aperture 32 during its rotating movements. Similar to the raised portion 33*a* shown in this disclosure, this alternate construction would require simultaneous operator pushing pressure and rotating movements to release the recess engaging portion from the depression.

Still another alternate construction is to modify the aperture 32*b* so that it extends completely through the top of the middle portion 28 of the trigger cover 24 and allows the spring 36 to slidably bear against the upper elongated element 22*b*. This would provide some resistance to the sliding movements of the cover 24 while exerting a downward pressure on the cover to ensure a snug fit. The spring may be provided with a cap to ensure a smooth sliding contact with the upper elongated element 22b.

The side wall 26a may be modified to include a raised portion positioned on the inside of such wall to correspond with the aperture 32b. Such raised portion would help maintain the position of the spring 36.

The aperture 34b for receiving a tool is shown as a screwdriver type slot. However, such aperture may be modified to employ other tools, such as an allen wrench, a key or other devices to perform the same function.

Plastic washers or other friction reducing devices may be employed above and below the spring 36 to reduce friction when the stud 34 is rotated during operation of the trigger cover 24.

The size, tension, shape and length of the spring 36 and the size and shape of the stud 34 may be modified and still function as intended. Furthermore, such spring may be constructed of steel or other suitable material, such as plastic.

The pair of elongated elements 22a and 22b may be constructed integrally with the trigger guard 20 as shown or may be constructed separately from the trigger guard and assembled on such guard. The elements may be bolted, welded or otherwise suitably fastened to the guard.

In the preferred embodiment, the bolts 30 are employed to secure the side walls 26a and 26b to the middle portion 28 of the cover 24, however, other means, such as rivets, pins, welding, gluing and the like, may be employed to accomplish the same function.

The trigger cover 24 may be constructed of stainless steel, aluminum, plastic or other suitable material. Furthermore, the side walls 26a and 26b may be constructed of transparent material, such as clear plastic, so the operator can observe the inner workings of the cover and the trigger.

Accordingly, the scope of the invention should be determined not by the embodiment illustrated, but by the appended claims and their legal equivalents.

Having thus described my invention, I claim:

1. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said combination also including connecting means for slidably connecting said trigger cover to said gun, said connecting means, when said trigger cover is in said closed position, positioning said trigger cover to cover and to restrict access to said trigger, said connecting means, when said trigger cover is in said open position, positioning said trigger cover to allow access to said trigger, said connecting means allowing said trigger cover to slide forwardly from said closed position to said open position, said trigger cover, in said open position, being positioned forwardly of said trigger.

2. The combination of claim 1 wherein said connecting means includes an elongated element extending longitudinally in the shooting direction of said gun, said elongated element for guiding said trigger cover during its sliding movements.

3. The combination of claim 2 wherein said trigger guard includes a bottom portion, said elongated element being positioned on said bottom portion of said trigger guard.

4. The combination of claim 1 wherein said connecting means includes a pair of elongated elements extending longitudinally in the shooting direction of said gun, said trigger guard including a bottom portion, said pair of elements including a first elongated element extending longitudinally along said bottom portion of said trigger guard and a second elongated element positioned above and parallel to said first elongated element.

5. The combination of claim 1 wherein said combination includes holding means for holding said trigger cover in said closed position, said holding means for restricting horizontal sliding movements of said trigger cover, said holding means being releasable to allow said trigger cover to slid forwardly from said closed position to said open position.

6. The combination of claim 5 wherein said holding means includes a hold position for holding said trigger cover in said closed position, said holding means being releasable from said hold position, said combination also including locking means for locking said holding means in said hold position to prevent said trigger cover from being slid forwardly from said closed position to said open position, both said holding means and said locking means being releasable to allow said trigger cover to slide forwardly from said closed position to said open position.

7. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said combination also including connecting means for slidably connecting said trigger cover to said gun, said connecting means, when said trigger cover is in said closed position, positioning said trigger cover to cover and to restrict access to said trigger, said connecting means, when said trigger cover is in said open position, positioning said trigger cover to allow access to said trigger, said connecting means allowing said trigger cover to slide forwardly from said closed position to said open position, said combination also including holding means for holding said trigger cover in said closed position, said holding means for restricting horizontal sliding movements of said trigger cover, said holding means including a stud for holding said trigger cover in said closed position, said stud extending vertically relative to said trigger cover.

8. The combination of claim 7 wherein said holding means includes an aperture extending through said trigger guard for receiving a portion of the vertically positioned stud.

9. The combination of claim 7 wherein said holding means includes a resilient member for urging said stud in a downwardly direction.

10. The combination of claim 7 wherein said stud includes receiving means for receiving a tool to activate said stud, said receiving means being operatively connected to said vertically positioned stud.

11. The combination of claim 10 wherein said stud includes a bottom end portion, said receiving means being positioned on said bottom end portion.

12. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said combination also including connecting means for operatively connecting said trigger cover to said gun, said trigger cover including front and rear portions, said rear portion including means for covering said trigger in said closed position of said trigger cover, said connecting means allowing said trigger cover to move forwardly from said closed position to said open position on a horizontal plane substantially parallel to the barrel, said trigger cover and said trigger being on substantially the same horizontal plane, said rear portion of said trigger cover, in said open position, being positioned in front of said trigger and on said horizontal plane of said trigger.

13. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open positon being a forwardly position of said trigger cover for exposing said trigger and allowing access to and operation of the latter, said closed position being a rearwardly position of said trigger cover for covering and restricting access to said trigger, said combination also including means for operatively connecting said trigger cover to said gun, said means positioning a substantial portion of said trigger cover in said trigger guard when said trigger cover is in said rearwardly closed position, said means also positioning a substantial portion of said trigger cover in said trigger guard when said trigger cover is in said forwardly open position.

14. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said combination also including connecting means for slidably connecting said trigger cover to said gun, said connecting means, when said trigger cover is in said closed position, positioning said trigger cover to cover and to restrict access to said trigger, said connecting means, when said trigger cover is in said open position, positioning said trigger cover to allow access to said trigger, said connecting means allowing said trigger cover to slide forwardly from said closed position to said open position, said combination also including holding means for holding said trigger cover in said closed position, said holding means for restricting horizontal sliding movements of said trigger cover, said trigger cover including a pair of oppositely positioned side walls and a middle portion positioned therebetween, said trigger cover also including window means in one of said side walls for observing said holding means.

15. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said combination also including connecting means for slidably connecting said trigger cover to said gun, said connecting means, when said trigger cover is in said closed position, positioning said trigger cover to cover and to restrict access to said trigger, said connecting means, when said trigger cover is in said open position, positioning said trigger cover to allow access to said trigger, said connecting means allowing said trigger cover to slide forwardly from said closed position to said open position, said combination also including holding means for holding said trigger cover in said closed position, said holding means for restricting horizontal sliding movements of said trigger cover, said holding means including a hold position for holding said trigger cover in said closed position, said holding means being releasable from said hold position, said combination also including locking means for locking said holding means in said hold position to prevent said trigger cover from being slid forwardly from said closed position to said open position, at least a portion of said holding means being rotatable, said combination also including anti-rotation means for stopping rotating movements of at least a portion of said holding means when said trigger cover is locked in said closed position by said locking means, said anti-rotation means allowing said holding means to be released from said locked position by simultaneous operator pushing pressure and rotating movements applied to said holding means.

* * * * *